US005408760A

United States Patent [19]

Tse et al.

[11] Patent Number: 5,408,760

[45] Date of Patent: Apr. 25, 1995

[54] AIR PUMPING AND VENTILATING DEVICE FOR A SHOE

[76] Inventors: Steven Tse, 9Fl., 120, Fu Ho Rd., Yung Ho City, Taipei Hsien, Taiwan, Prov. of China; Kuo-Neng Chien, 4 Fl., No. 27, Lane 160, Hsin Sheng S. Road, Sec. 1, Taipei, Taiwan, Prov. of China

[21] Appl. No.: 103,485

[22] Filed: Aug. 6, 1993

Related U.S. Application Data

[63] Continuation-in-part of Ser. No. 937,357, Aug. 27, 1992, abandoned.

[51] Int. Cl.[6] ..... A43B 7/06

[52] U.S. Cl. ..... 36/3 B; 36/3 R

[58] Field of Search ..... 36/3 R, 3 A, 3 B, 147

[56] References Cited

U.S. PATENT DOCUMENTS

| | | | |
|---|---|---|---|
| 635,101 | 10/1899 | Kennedy | 36/3 B |
| 4,633,597 | 1/1987 | Shiang | 36/3 B X |
| 4,654,982 | 4/1987 | Lee | 36/3 B X |
| 4,860,463 | 8/1989 | Pin | 36/3 B |
| 4,999,932 | 3/1991 | Grim | 36/3 B X |
| 5,068,981 | 12/1991 | Jung | 36/3 B X |
| 5,138,775 | 8/1992 | Chu | 36/3 B |

FOREIGN PATENT DOCUMENTS

| | | | |
|---|---|---|---|
| 2532158 | 3/1984 | France | 36/3 B |
| 0520407 | 3/1955 | Italy | 36/3 B |
| 0538325 | 7/1956 | Italy | 36/3 B |
| 8703789 | 7/1987 | WIPO | 36/3 R |

*Primary Examiner*—Paul T. Sewell
*Assistant Examiner*—Ted Kavanaugh
*Attorney, Agent, or Firm*—Pro-Techtor International

[57] ABSTRACT

A shoe is provided with an air pumping device capable of supplying fresh air from the ambient atmosphere into the interior of the shoe. The air pumping device is detachable from the shoe so that it can be cleaned to remove dirts or alien objects that may block the air flow path. The air pumping device is located beneath the forepart of a foot wearing the shoe. When the user makes a step forward, an air bag is compressed at the instant the forepart of the foot is bent to lift the heel off the ground, thereby generating an air pumping action. When the forepart of the foot stretches straight again, the air bag restores to its original shape, thereby generating an air sucking action. As the user keeps moving, the air pumping device will pump air successively from the ambient atmosphere into the interior of the shoe. The air flow direction may be reversed so as to pump air inside the shoe out to the ambient atmosphere.

5 Claims, 5 Drawing Sheets

AIR PUMPING AND VENTILATING DEVICE FOR A SHOE

This application is a continuation-in-part of parent application Ser. No. 07/937,357, filed Aug. 27, 1992, now abandoned.

BACKGROUND OF THE INVENTION

1. Field of the Invention

The present invention relates to a shoe, and more particularly to a shoe provided with an air pumping device for supply fresh air into the interior of the shoe.

2. Description of Prior Art

In using a shoe with the heretofore conventional type of insole, the foot engaged with the insole will often cause trauma to the foot of the wearer during walking and running under sufficient pressure. Moreover, since the uppers of most shoes enclose and press the foot down on the insole, heated air, as well as body heat, are trapped between the sole and the shoe insole, thereby causing discomfort to the wearer. This is all the more true in the summertime when sweat and partially concentrated blood accumulation over the foot area will in most cases cause much pain to the wearer. To solve this problem, an air-cushion insole was proposed by Mr. James Faiella, U.S. Patent application Ser. No. 369,133 filed on Apr. 16, 1982, as an improvement on conventional insole for a shoe. However, it is found that such an improvement nonetheless has dissatisfactory drawbacks, such as that fresh air from the ambient atmosphere can not be pumped into the interior of the shoe. In U.S. Pat. No. 5,138,755, Chu teaches a shoe having an air pumping structure provided at the heel of the shoe for supplying fresh air to the interior of the shoe. Compression force is found not satisfactorily exerted to the structure to cause great air pumping effect. Furthermore, after removing the structure for cleaning purpose, the number of disassembled parts makes the reassemble work difficult.

SUMMARY OF THE INVENTION

It is a primary objective of the present invention to provide an air pumping device to a shoe so that air from the ambient atmosphere can be pumped into the interior of the shoe when a user wearing the shoe makes a step on foot.

It is a second objective of the present invention to provide an air pumping device to a shoe, which is detachable from the shoe for cleaning.

In accordance with the foregoing and other objectives of the present invention, a shoe with a featured air pumping device is provided. The shoe includes a sole provided with a hollowed portion at a selected position of the sole. An flat, oval-shaped and resilient air bag is mounted in the hollowed portion of the sole. The air bag is equipped with an inlet one-way valve in air communication with the atmosphere when it is open and an outlet one-way valve. An insole is provided with a plurality of vents in air communication with the outlet one-way valve for ventilating air into the interior of the shoe.

The air bag is compressed when the air bag is bent due to an external bending force exerted by the forepart of the user's foot. This causes the outlet one-way valve to open and the inlet one-way valve to close, thus pushing air through said at least one vent into the interior of said shoe. After being compressed and the external bending force is removed, the air bag restores from compressed state to non-compressed state by means of its resilient property. This action causes the inlet one-way valve to open and the outlet one-way valve to close, thus sucking air from the ambient atmosphere through said inlet one-way valve into said air bag. The air bag is removable from the hollowed portion of the sole for cleaning purpose.

In the second embodiment, the outlet one-way valve can be eliminated. Although in this manner, the air will suck fresh air from the atmosphere and sultry air from the interior of the shoe, the air ventilation effect is still satisfactory. In winter season, the inlet one-way valve and the outlet one-way valve can be reversely mounted, so that air inside the shoe is pumped out to the ambient atmosphere.

BRIEF DESCRIPTION OF THE DRAWINGS

The present invention can be more fully understood by reading the subsequent detailed description of the preferred embodiments thereof with references made to the accompanying drawings, wherein.

DETAILED DESCRIPTION OF THE PREFERRED EMBODIMENTS

First Embodiment

Figures 1A, 1B:
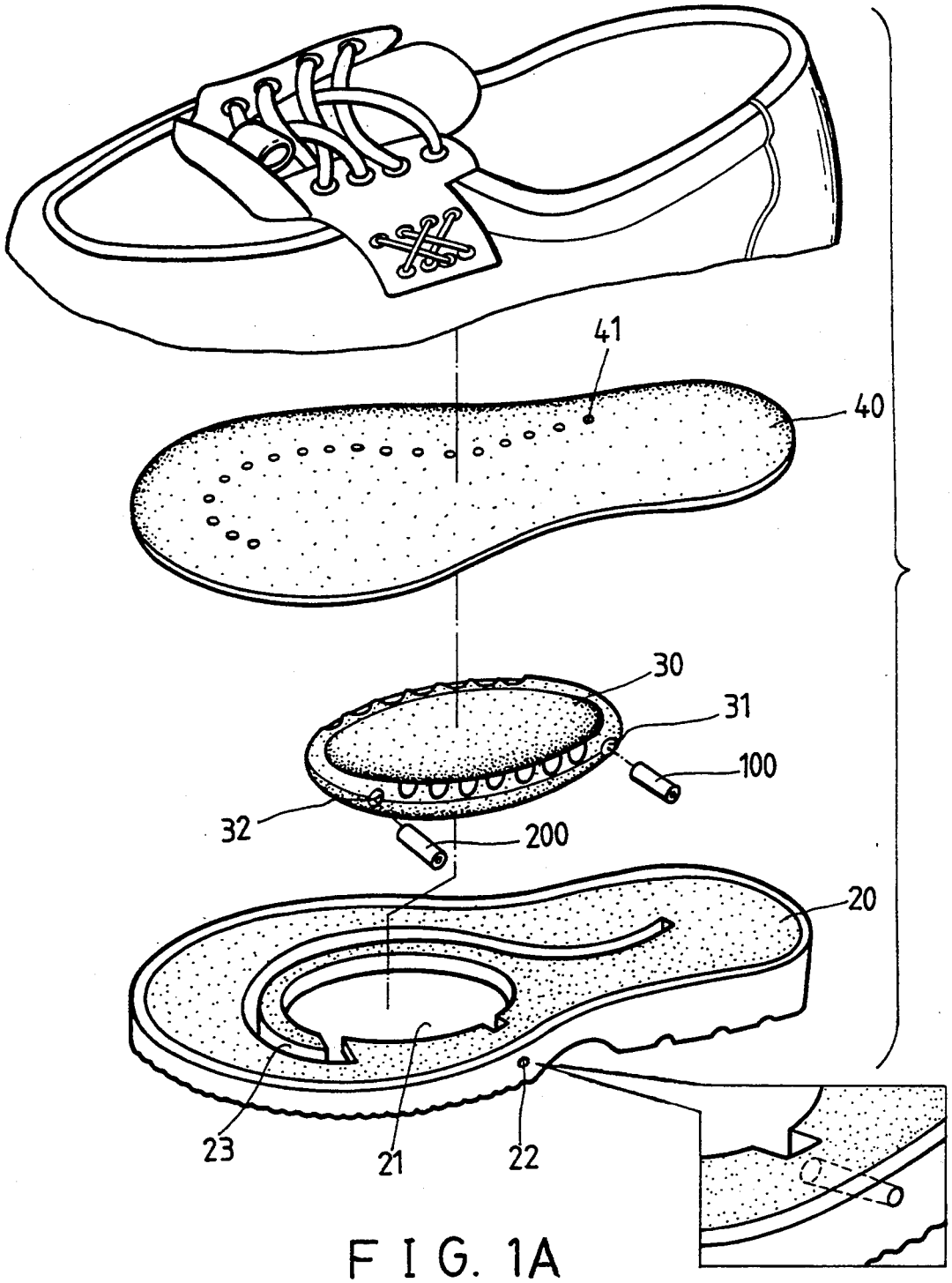
FIG. 1 is an exploded perspective view of a shoe made according to the present invention.

Referring to FIG. 1, the exploded view shows the constituent parts of a shoe made in accordance with the present invention. The shoe includes a sole 20 and an insole 40. The sole 20 is provided with a hollowed portion 21, an air intake hole 22 for allowing the hollowed portion 21 to be in air communication with the ambient atmosphere, and a groove 23.

Figure 2:
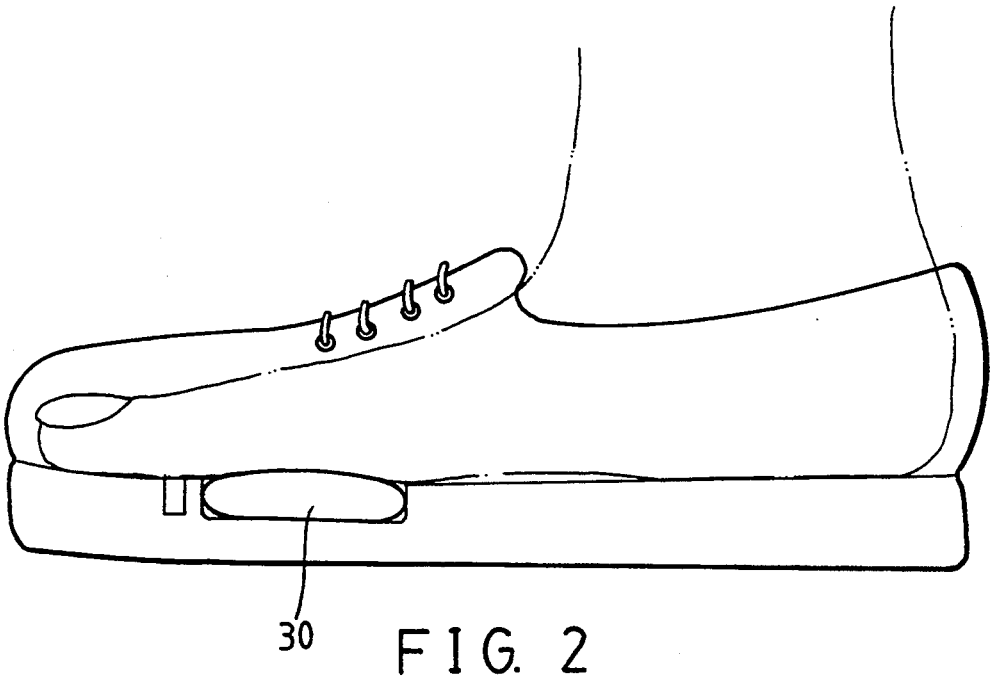
FIG. 2 illustrates the shoe of the present invention when assembled and worn by a foot.

In accordance with a first important aspect of the present invention, the hollowed portion 21 is provided at a selected position such that when the shoe is worn by a user, as illustrated in FIG. 2, the hollowed portion 21 is located beneath the forepart of the user's foot. The reason for such a selection will be explained later in this section.

Figure 4:
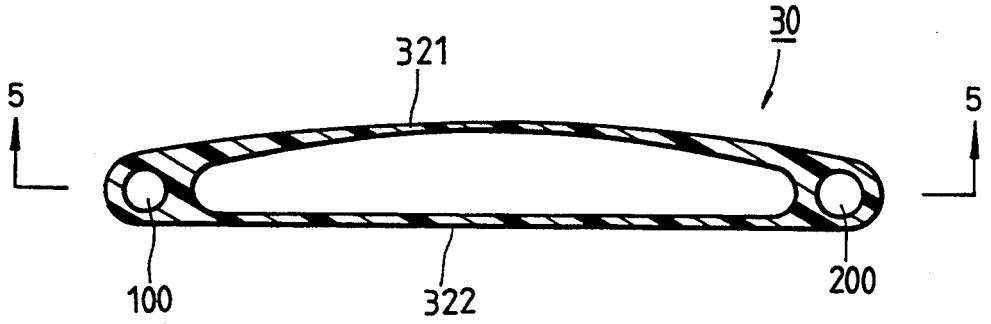
FIG. 4 is a cross sectional view of an air bag utilized in the shoe of the present invention.
Figure 5A:
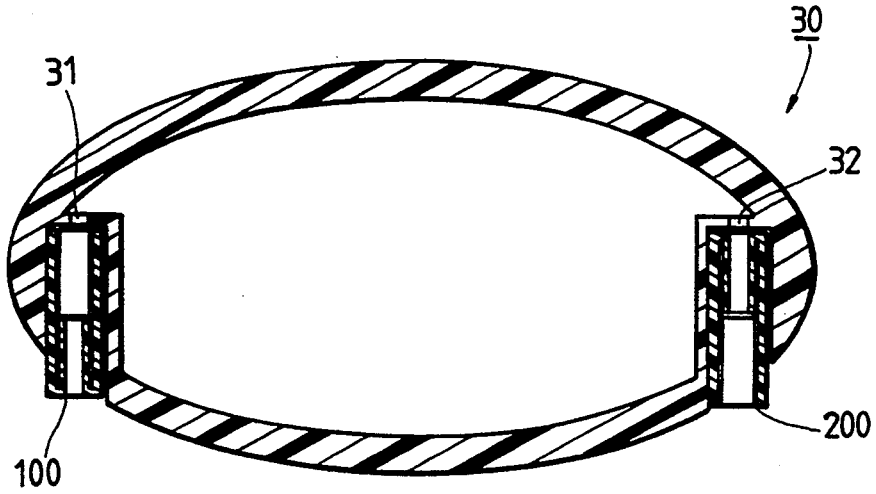
FIG. 5A–5D are sectional views taken on line 5—5 of the air bag of FIG. 4.

An air bag 30, flat and oval in shape and made of resilient material, is accommodated in the hollowed portion 21. The detailed structure of the air bag 30 is shown in FIG. 4 and FIG. 5A. The air bag 30 is provided with two openings, an air inlet opening 31 and an air outlet opening 32. The air bag 30 has an upper wall 321 slightly arched and thinner than its lower wall 322, allowing the air bag 30 to be bent upwards easily and to restore quickly back to the original shape after being bent.

Figure 5B:
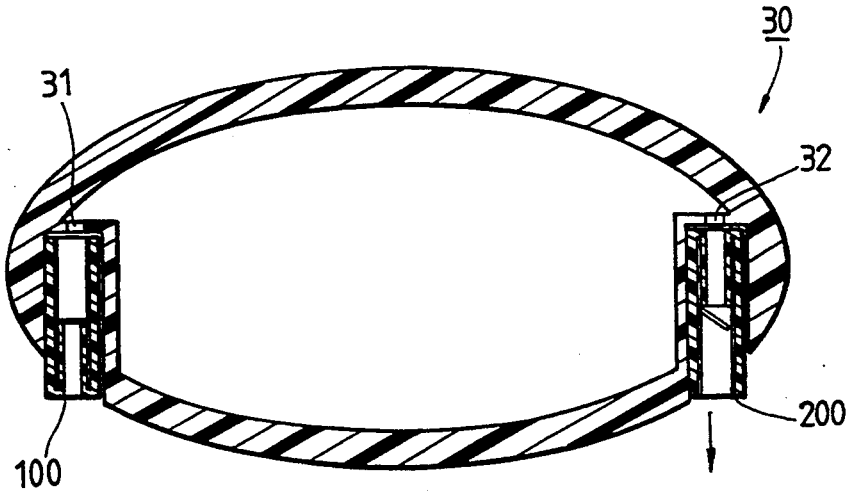
Figure 5C:
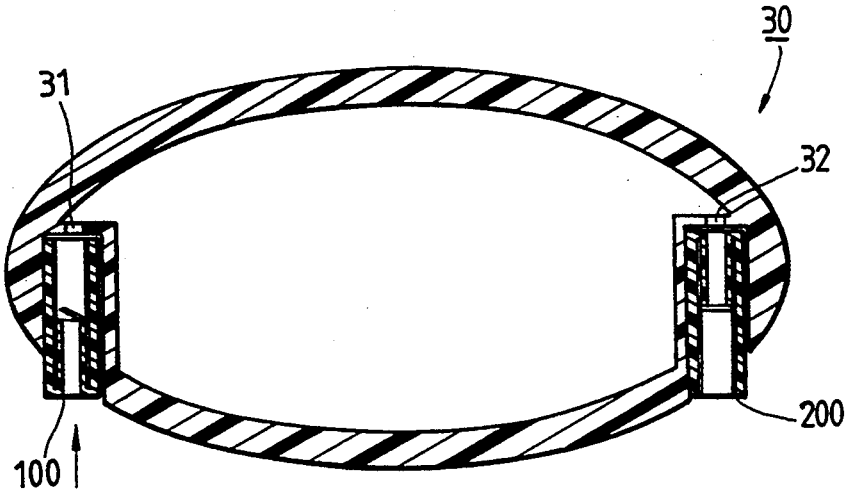

Referring both to FIG. 1 and FIGS. 5B–5C, a pair of one-way valve 100, 200 are inserted respectively into the air inlet opening 31 and the air outlet opening 32. The two one-way valves 100, 200 are identical in structure, except inserted in different directions: the inlet one-way valve 100 only allows air to flow from the outside into the air bag 30; and the outlet one-way valve 200 allows air only to flow out of the air bag 30.

Figure 6:
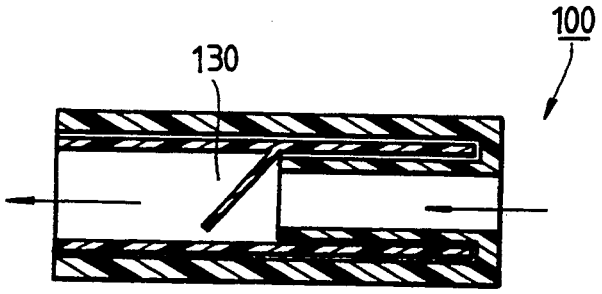
FIG. 6 is a longitudinal sectional view of a one-way valve utilized in the shoe of the present invention, showing when it is open.
Figure 7:
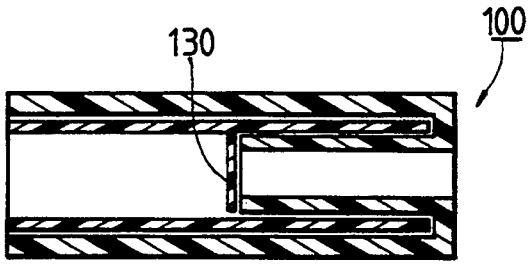
FIG. 7 shows the one-way valve of FIG. 6 when it is closed.
Figure 8:
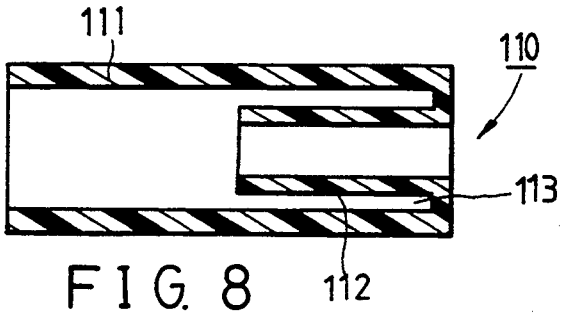
FIG. 8 is a longitudinal sectional view of an external tube used to constitute the one-way valve of FIG. 7.
Figure 9:
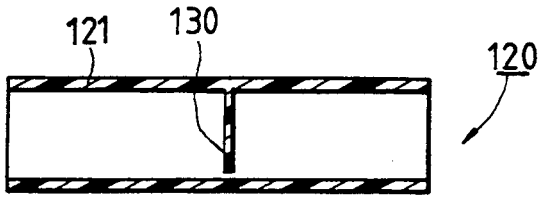
FIG. 9 is a longitudinal sectional view of an internal tube used to constitute the one-way valve of FIG. 7.
Figure 10:
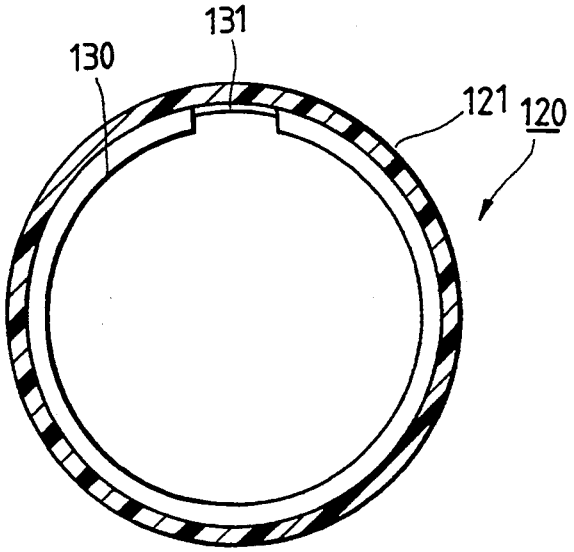
FIG. 10 is a cross sectional view of the one-way valve of FIG. 7.

Referring to FIGS. 6–10, since the two one-way valve 100, 200 are identical in structure, the description hereunder is only directed to the one-way valve 100. The one-way valve 100 is constituted by combining two parts, an external part 110 as shown in FIG. 8 and an internal part 120 as shown in FIG. 9. The external part 110 is comprised of an outer tube 111 and an integrally formed inner tube 112. The outer tube 111 sleeves the inner tube 112 with a gap formed therebetween. The internal part 120 is composed of an insertion tube 121 and a lid 130 flexibly hinged at one segment 131 on its edge as shown in FIG. 10.

The outer diameter of the insertion tube 121 is in match with the inner diameter of the outer tube 111, so that the insertion tube 121 can be inserted into the outer tube 111. In 110, the width of the gap 113 between the outer tube 111 and the inner tube 112 is in match with but slightly less than the thickness of the wall of the insertion tube 121, so that the insertion tube 121, when inserted, can be clamped tightly.

The lid 130 is a circular piece of soft flexible material, preferably plastics. As shown in FIG. 7, when the two parts 110, 120 are combined, the lid 130 covers the end opening of the inner tube 112. As shown in FIG. 7, when air blows from right to left, the lid 130 pivots to the left, thereby allowing air to pass through the one-way valve. On the other hand, as shown in FIG. 6, when air blows from left to right, the lid 130 is retarded by the rim of the end opening of the inner tube 112, thereby blocking the air flow.

Referring back to FIG. 1, when the air bag is mounted to the hollowed portion 21, the inlet one-way valve 100 is coupled to the air intake hole 22, and the outlet one-way valve 200 is coupled to the end of the groove 23. The insole 40 is provided with a plurality of vents 41 arranged along a course in match with the groove 23.

Figure 3:
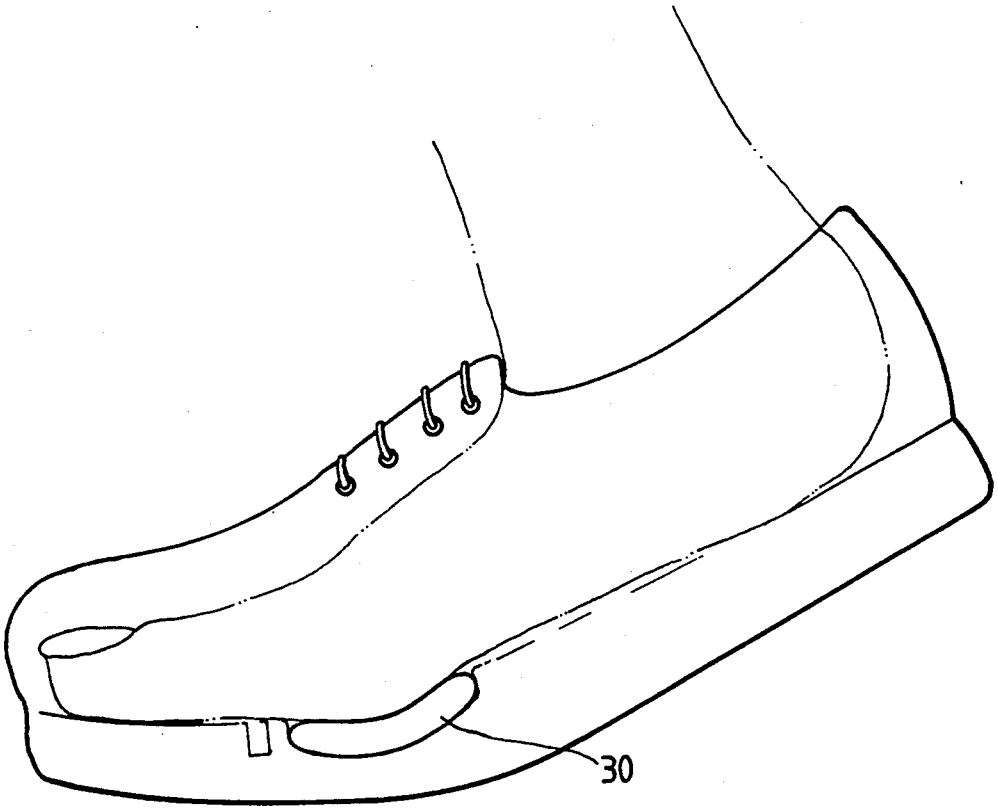
FIG. 3 shows the shoe of the present invention when worn by a foot and when the user wearing the shoe moves the foot.

As shown in FIG. 2, when the shoe is worn by the foot of a user, the air bag 30 is located beneath the forepart of the user's foot. According to biomechanics, when the user makes a step on foot, such as when walking, running, or dancing, the forepart of the user's foot bends at the instant the foot is about to lift off the ground, as illustrated in FIG. 3. The bending of the foot cause the air bag 30 to be bent too, whereby the air bag 30 is compressed. The air inside the air bag 30, being compressed, finds its way out of the air bag through the outlet one-way valve 200. The air expelled out of the air bag through the outlet one-way valve 200 is directed through the groove 23 and the vents 41 into the interior of the shoe.

When the shoe is lifted in the air, the user's foot is stretched straight. The bending force is therefore removed from the air bag 30. The air bag 30, having been compressed, restores itself to the original shape at this time due to its resilient property and its special designed structure mentioned above. The restoration of the air bag 30 thus causes a sucking force so that air in the ambient atmosphere is sucked through the air intake hole 22 and the inlet one-way valve 100 into the air bag 30. Accordingly, when the user continues advancing on foot, the air bag 30 acts as an air pump, successively sucking air thereinto and then expelling the intake air to the interior of the shoe.

Second Embodiment

Figure 5D:
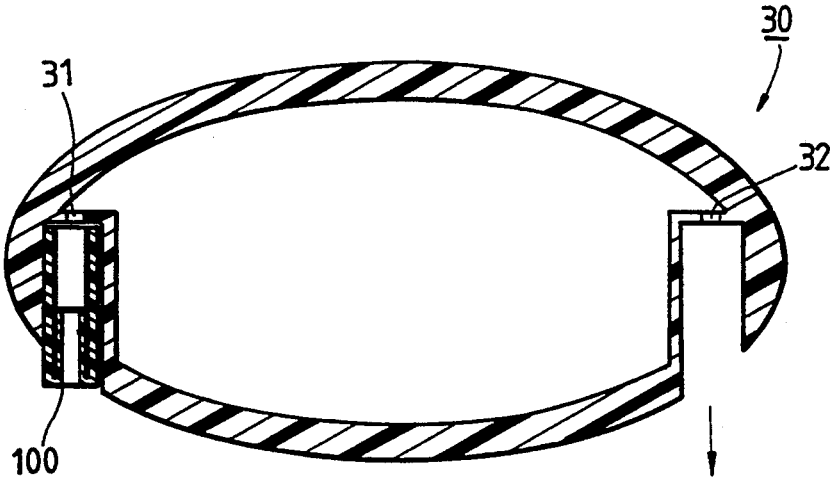

In the second embodiment, the outlet one-way valve 200 is removed from the air bag 30 as shown in FIG. 5D. This embodiment, although slightly less preferable than the first embodiment, is nonetheless workable. When the air bag 30 expands, it sucks air both from the inlet one-way valve 100 and from the outlet opening 32. As a result, a small part of the sultry air in the interior of the shoe may be sucked back into the air-bag 30 and then pumped back again. However, the majority of the air is still sucked from the atmosphere, so that satisfactory air ventilation effect is still provided.

Third Embodiment

The foregoing described embodiment is suitable for wearing in the summer season, since at this season cool air from the ambient atmosphere is needed to blow into the interior of the shoe to ventilate sultry and stink air there. In the winter season, or on a rainy day, both the inlet one-way valve 100 and the outlet one-way valve 200 can be reversely inserted, so that, instead of pumping air from the ambient atmosphere into the interior of shoe, air inside the shoe is sucked and pumped out to by the air bag 30 out to the ambient atmosphere.

Another important aspect of the present invention is that the air bag 30 is detachable from the shoe. The insole 40 is uncovered first and then the air bag 30 can be taken out by hand. To clean dirts, dust, or any other alien objects accumulated on the one-way valve 100, 200, they can be detached from the air bag 30 for cleaning. After that, the air bag 30 and the one-way valve 100, 200 can be reassembled and installed back to the hollowed portion 21 of the shoe.

The present invention has been described with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A shoe which supplies air from the ambient atmosphere to the interior of the shoe when a user wearing the shoe on a foot moves from one place to another, comprising:

(a) a sole for the foot to rest thereupon, having a hollowed portion provided at a selected position of said sole upon which the forepart of the foot of the user rests, and (b) an air bag substantially flat in shape, made of resilient material, having:

(1) an inlet one-way valve in air communication with the atmosphere when it is open, allowing air to flow only in the direction from the ambient atmosphere into the air bag;

(2) an outlet one-way valve allowing air to flow only out of said air bag;

(c) an insole placed upon said sole, having at least one vent in air communication with said outlet one-way valve for ventilating air into the interior of the shoe;

wherein said air bag is compressed when said air bag is bent due to an external bending force exerted by the forepart of the user's foot, thereby causing said outlet one-way valve to open and said inlet one-way valve to close, thus pushing air through said at least one vent into the interior of said shoe; and wherein after being compressed and the external bending force is removed, said air bag restores from compressed state to non-compressed state by means of its resilient property, thereby causing said inlet one-way valve to open and said outlet one-way valve to close, thus sucking air from the ambient atmosphere through said inlet one-way valve into said air bag; and wherein said air bag is removable from said hollowed portion of said sole; and wherein said inlet one-way valve comprises:

(a) a first part including:

(1) an outer tube and (2) an inner tube sleeved by said outer tube with a gap formed therebetween, said inner tube having a first end opening integrally formed with said outer tube and a second end opening on the inside of said outer tube; and (b) a second part including:

(1) an insertion tube, inserted into said outer tube of said first part to be clamped in said gap between said outer tube and said inner tube, (2) a circular lid flexibly hinged at one segment on its edge and covering said second end opening of said inner tube.

2. A shoe which supplies air from the ambient atmosphere to the interior of the shoe when a user wearing the shoe on a foot moves from one place to another, comprising:

(a) a sole for the foot to rest thereupon, having a hollowed portion provided at a selected position of said sole upon which the forepart of the foot of the user rests, and (b) an air bag substantially flat in shape, made of resilient material, having:

(1) an inlet one-way valve in air communication with the atmosphere when it is open, allowing air to flow only in the direction from the ambient atmosphere into the air bag;

(2) an outlet one-way valve allowing air to flow only out of said air bag;

(c) an insole placed upon said sole, having at least one vent in air communication with said outlet one-way valve for ventilating air into the interior of the shoe;

wherein said air bag is compressed when said air bag is bent due to an external bending force exerted by the forepart of the user's foot, thereby causing said outlet one-way valve to open and said inlet one-way valve to close, thus pushing air through said at least one vent into the interior of said shoe; and wherein after being compressed and the external bending force is removed, said air bag restores from compressed state to non-compressed state by means of its resilient property, thereby causing said inlet one-way valve to open and said outlet one-way valve to close, thus sucking air from the ambient atmosphere through said inlet one-way valve into said air bag; and wherein said air bag is removable from said hollowed portion of said sole; and wherein said outlet one-way valve comprises:

(a) a first part including:

(1) an outer tube and (2) an inner tube sleeved by said outer tube with a gap formed therebetween, said inner tube having a first end opening integrally formed with said outer tube and a second end opening substantially on the inside of said outer tube; and (b) a second part including:

(1) an insertion tube, inserted into said outer tube of said first part to be clamped in said gap between said outer tube and said inner tube, (2) a circular lid flexibly hinged at one segment on its edge and covering said second end opening of said inner tube.

3. A shoe which supplies air from the ambient atmosphere to the interior of the shoe when a user wearing the shoe on a foot moves from one place to another, comprising:

(a) a sole for the foot to rest thereupon, having a hollowed portion provided at a selected position of said sole upon which the forepart of the foot of the user rests, and (b) an air bag substantially flat in shape, made of resilient material, having:

(1) an inlet one-way valve in air communication with the atmosphere when it is open, allowing air to flow only in the direction from the ambient atmosphere into the air bag;

(2) an outlet opening allowing air to flow only out of said air bag;

(c) an insole placed upon said sole, having at least one vent in air communication with said outlet opening for ventilating air into the interior of the shoe;

wherein said air bag is compressed when said air bag is bent due to an external bending force exerted by the forepart of the user's foot, thereby causing said inlet one-way valve to close, thus pushing air through said outlet opening and through said at least one vent into the interior of said shoe; and wherein after being compressed and the external bending force is removed, said air bag restores from compressed state to non-compressed state by means of its resilient property, thereby causing said inlet one-way valve to open, thus sucking air from the ambient atmosphere through said inlet one-way valve and air from the interior of the shoe through said outlet opening into said air bag; and wherein said air bag is removable from said hollowed portion of said sole; and wherein said inlet one-way valve comprises:

(a) a first part including:

(1) an outer tube and (2) an inner tube sleeved by said outer tube with a gap formed therebetween, said inner tube having a first end opening integrally formed with said outer tube and a second end opening on the inside of said outer tube; and (b) a second part including:

(1) an insertion tube, inserted into said outer tube of said first part to be clamped in said gap between said outer tube and said inner tube, (2) a circular lid flexibly hinged at one segment on its edge and covering said second end opening of said inner tube.

4. A shoe which supplies air from the ambient atmosphere to the interior of the shoe when a user wearing the shoe on a foot moves from one place to another, comprising:

(a) a sole for the foot to rest thereupon, having a hollowed portion provided at a selected position of said sole upon which the forepart of the foot of the user rests, and (b) an air bag substantially flat in shape, made of resilient material, having:

(1) an inlet one-way valve in air communication with the atmosphere when it is open, allowing air to flow only in the direction from the ambient atmosphere into the air bag;

(2) an outlet one-way valve allowing air to flow only out of said air bag;

(c) an insole placed upon said sole, having at least one vent in air communication with said inlet one-way valve;

wherein said air bag is compressed when said air bag is bent due to an external bending force exerted by the forepart of the user's foot, thereby causing said inlet one-way valve to close and said outlet one-way valve to open, thus pushing air through said outlet one-way valve to the atmosphere; and wherein after being compressed and the external bending force is removed, said air bag restores from compressed state to non-compressed state by means of its resilient property, thereby causing said inlet one-way valve to open and said outlet one-way valve to close, thus sucking air from the interior of the shoe through said inlet one-way valve into said air bag; and wherein said air bag is removable from said hollowed portion of said sole; and wherein said inlet one-way valve comprises:

(a) a first part including:

(1) an outer tube and (2) an inner tube sleeved by said outer tube with a gap formed therebetween, said inner tube having a first end opening integrally formed with said outer tube and a second end opening on the inside of said outer tube; and (b) a second part including:

(1) an insertion tube, inserted into said outer tube of said first part to be clamped in said gap between said outer tube and said inner tube, (2) a circular lid flexibly hinged at one segment on its edge and covering said second end opening of said inner tube.

5. A shoe which supplies air from the ambient atmosphere to the interior of the shoe when a user wearing the shoe on a foot moves from one place to another, comprising:

(a) a sole for the foot to rest thereupon, having a hollowed portion provided at a selected position of said sole upon which the forepart of the foot of the user rests, and (b) an air bag substantially flat in shape, made of resilient material, having:

(1) an inlet one-way valve in air communication with the atmosphere when it is open, allowing air to flow only in the direction from the ambient atmosphere into the air bag;

(2) an outlet one-way valve allowing air to flow only out of said air bag;

(c) an insole placed upon said sole, having at least one vent in air communication with said inlet one-way valve;

wherein said air bag is compressed when said air bag is bent due to an external bending force exerted by the forepart of the user's foot, thereby causing said inlet one-way valve to close and said outlet one-way valve to open, thus pushing air through said outlet one-way valve to the atmosphere; and wherein after being compressed and the external bending force is removed, said air bag restores from compressed state to non-compressed state by means of its resilient property, thereby causing said inlet one-way valve to open and said outlet one-way valve to close, thus sucking air from the interior of the shoe through said inlet one-way valve into said air bag; and wherein said air bag is removable from said hollowed portion of said sole; and wherein said outlet one-way valve comprises:

(a) a first part including:

(1) an outer tube and (2) an inner tube sleeved by said outer tube with a gap formed therebetween, said inner tube having a first end opening integrally formed with said outer tube and a second end opening on the inside of said outer tube; and (b) a second part including:

(1) an insertion tube, inserted into said outer tube of said first part to be clamped in said gap between said outer tube and said inner tube, (2) a circular lid flexibly hinged at one segment on its edge and covering said second end opening of said inner tube.

* * * * *